US012454789B2

(12) United States Patent
Leibman et al.

(10) Patent No.: US 12,454,789 B2
(45) Date of Patent: Oct. 28, 2025

(54) DRYER APPLIANCE AND METHOD FOR CLEANING OPERATION

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Kenneth G. Rudolph, Louisville, KY (US); Nemetalla Salameh, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 747 days.

(21) Appl. No.: 17/696,149

(22) Filed: Mar. 16, 2022

(65) Prior Publication Data

US 2023/0295865 A1 Sep. 21, 2023

(51) Int. Cl.

| | |
|---|---|
| ***D06F 105/38*** | (2020.01) |
| ***D06F 58/26*** | (2006.01) |
| ***D06F 58/30*** | (2020.01) |
| ***D06F 58/45*** | (2020.01) |
| ***D06F 105/40*** | (2020.01) |
| ***D06F 105/42*** | (2020.01) |

(52) U.S. Cl.
CPC ..... *D06F 58/45* (2020.02); *D06F 58/26* (2013.01); *D06F 58/30* (2020.02)

(58) Field of Classification Search
CPC ..... D06F 2105/38; D06F 2105/40; D06F 2105/42
See application file for complete search history.

(56) References Cited

U.S. PATENT DOCUMENTS

| | | | |
|---|---|---|---|
| 8,850,856 | B2 | 10/2014 | Leibman et al. |
| 9,708,751 | B2 | 7/2017 | Bae et al. |
| 9,834,882 | B2 | 12/2017 | Patil |
| 9,920,989 | B2 | 3/2018 | Luy et al. |
| 10,006,706 | B2 | 6/2018 | Luy et al. |
| 10,012,441 | B2 | 7/2018 | Mardikian |
| 10,184,205 | B2 | 1/2019 | Bison et al. |

(Continued)

FOREIGN PATENT DOCUMENTS

| | | | | |
|---|---|---|---|---|
| DE | 102008057663 A1 * | 6/2009 | ..... | D06F 58/203 |
| TR | 201310606 A * | 3/2015 | ..... | A47L 15/4418 |
| WO | WO2021/137487 A1 | 7/2021 | | |

OTHER PUBLICATIONS

English translation of DE 102008057663 by PE2E Dec. 20, 2024.*
English translation of TR201310606 by PE2E Mar. 27, 2025.*

*Primary Examiner* — Deming Wan
(74) *Attorney, Agent, or Firm* — Dority & Manning, P.A.

(57) ABSTRACT

A dryer appliance including a drum, a heater assembly, a reservoir, and a controller is provided. The drum defines a chamber for receipt of articles for drying. The heater assembly is in fluid communication with the chamber to flow air thereto. The reservoir is configured to receive a fluid, such as a cleaning solution, a disinfecting solution, or a perfume solution. The reservoir is in selective fluid communication with the chamber to provide the fluid to the chamber. The controller is configured to perform operations that, when executed by the controller, causes the dryer appliance to perform operations. The operations include flowing fluid to the chamber from the reservoir.

16 Claims, 10 Drawing Sheets

(56) References Cited

U.S. PATENT DOCUMENTS

| | | | | |
|---|---|---|---|---|
| 10,196,773 | B2 | 2/2019 | Bison et al. | |
| 10,576,757 | B2 | 3/2020 | Nakamura et al. | |
| 10,987,626 | B2 | 4/2021 | Klidas et al. | |
| 2011/0162224 | A1 | 7/2011 | Bae et al. | |
| 2014/0033559 | A1* | 2/2014 | Bellinger | D06F 58/38 219/442 |
| 2021/0010187 | A1* | 1/2021 | Cattorini | D06F 39/028 34/427 |

* cited by examiner

DRYER APPLIANCE AND METHOD FOR CLEANING OPERATION

FIELD OF THE INVENTION

The present subject matter relates generally to dryer appliances, or more specifically, to apparatuses and methods of operation for cleaning dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a system for passing dry, heated air through the chamber in order to dry moisture-laden articles positioned therein. Typically, an air handler or blower is used to urge the flow of heated air through the chamber to dry the clothes.

Dryer appliances may occasionally develop undesired smells, odors, bacterial, microbial, or fungal growth. For instance, commercial dryer appliances may be used at such rates that permit dirty laundry chambers while being burdensome to the user or owner to clean and disinfect at intervals that may mitigate dirt, germ, or other undesired build-up or growth.

Certain dryer appliance configurations may include a steam function and other post-dry functions. Such systems may create or exasperate dirty laundry issues by allowing water or water vapor to enter or build up at surfaces of the dryer appliance. Unlike washing machine appliances, such surfaces at dryer appliances may not typically come into contact with a detergent or other cleaning solutions.

Accordingly, a dryer appliance with cleaning and disinfecting features is desired. More particularly, apparatuses and methods for cleaning and disinfecting a dryer appliance are desired.

BRIEF DESCRIPTION OF THE INVENTION

Advantages of the invention will be set forth in part in the following description, or may be apparent from the description, or may be learned through practice of the invention.

An aspect of the present disclosure is directed to a dryer appliance. The dryer appliance includes a drum rotatably mounted within a cabinet. The drum defines a chamber for receipt of articles for drying. The dryer appliance includes a heater assembly in fluid communication with the chamber. The heater assembly includes a blower fan configured to flow air through the heater assembly. The heater assembly is configured to selectively generate heat and remove moisture from the air flowing through the heater assembly. A reservoir is configured to receive a fluid. The reservoir is in selective fluid communication with the chamber to provide the fluid to the chamber. A controller is configured to perform operations that, when executed by the controller, causes the dryer appliance to perform operations. The operations include flowing fluid to the chamber from the reservoir. The fluid is a cleaning solution, a disinfecting solution, or a perfume solution.

Another aspect of the present disclosure is directed to a method for operating a dryer appliance. The method includes flowing a fluid from a reservoir at the dryer appliance to a chamber configured to receive laundry articles for drying. The fluid is a cleaning solution, a disinfecting solution, or a perfume solution. The method includes operating a blower fan to flow air through a heater assembly of the dryer appliance to the chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
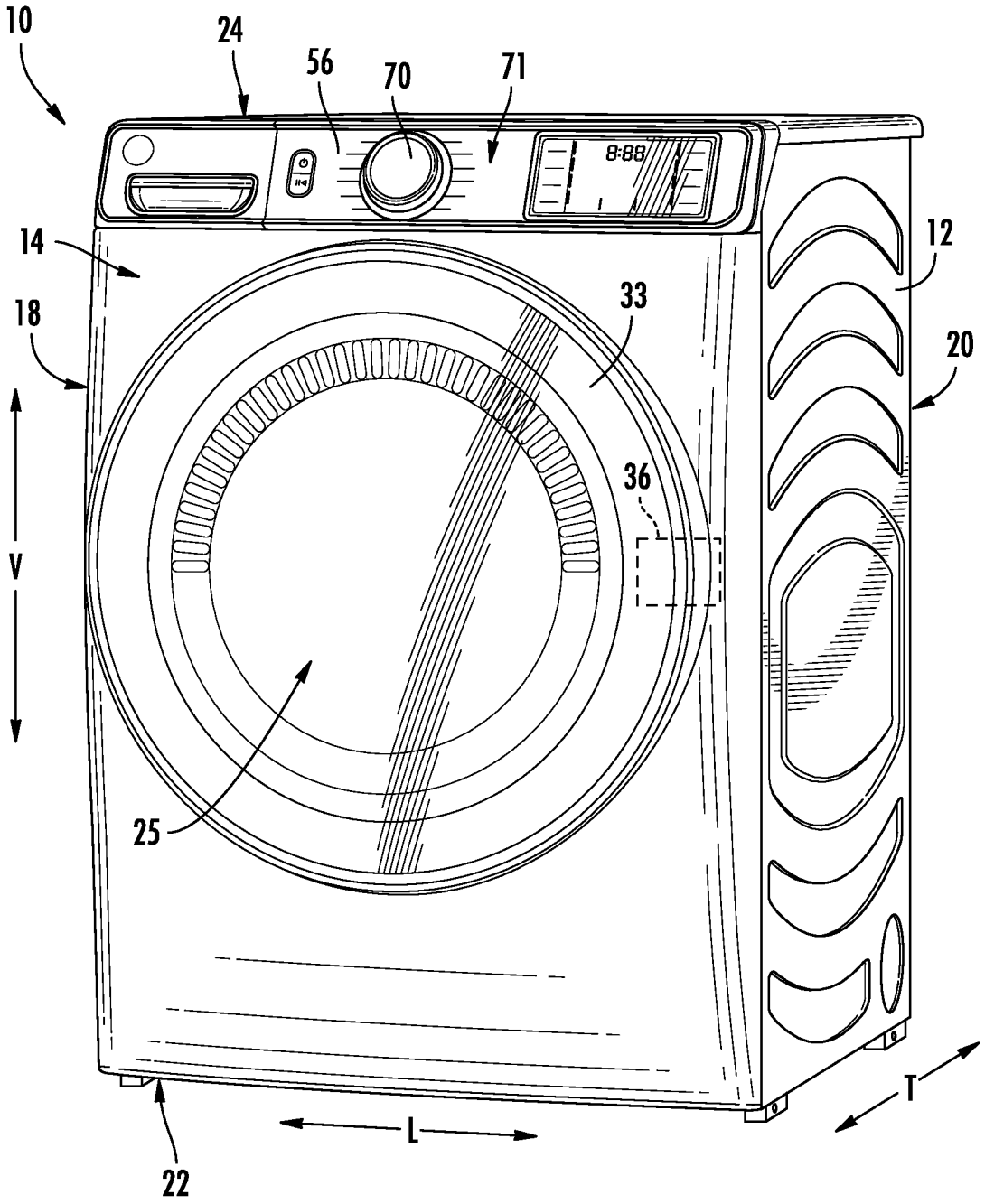
FIG. 1 provides a perspective view of a dryer appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
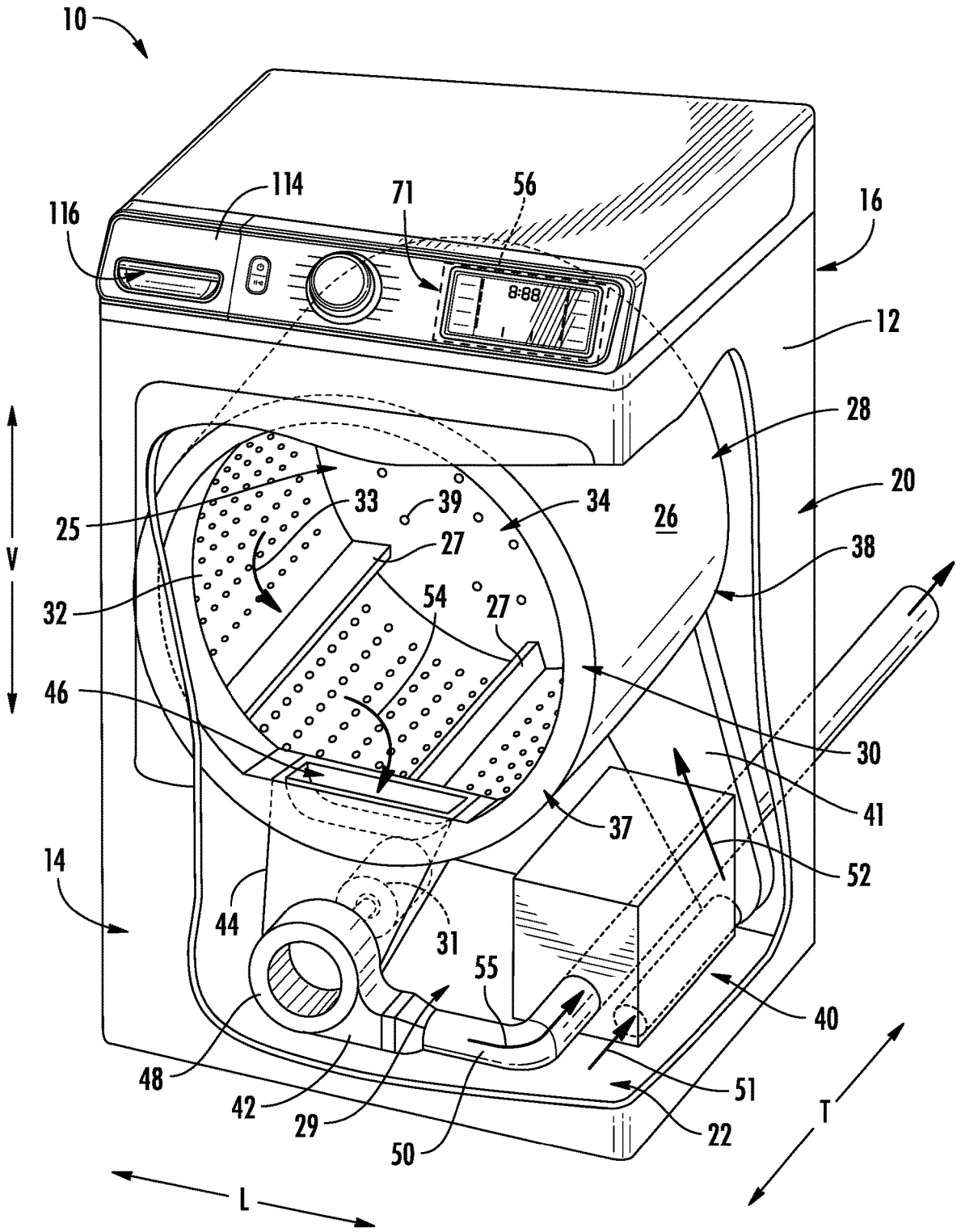
FIG. 2 provides a perspective view of the example dryer appliance of FIG. 1 with portions of a cabinet of the dryer appliance removed to reveal certain components of the dryer appliance.
Figure 3:
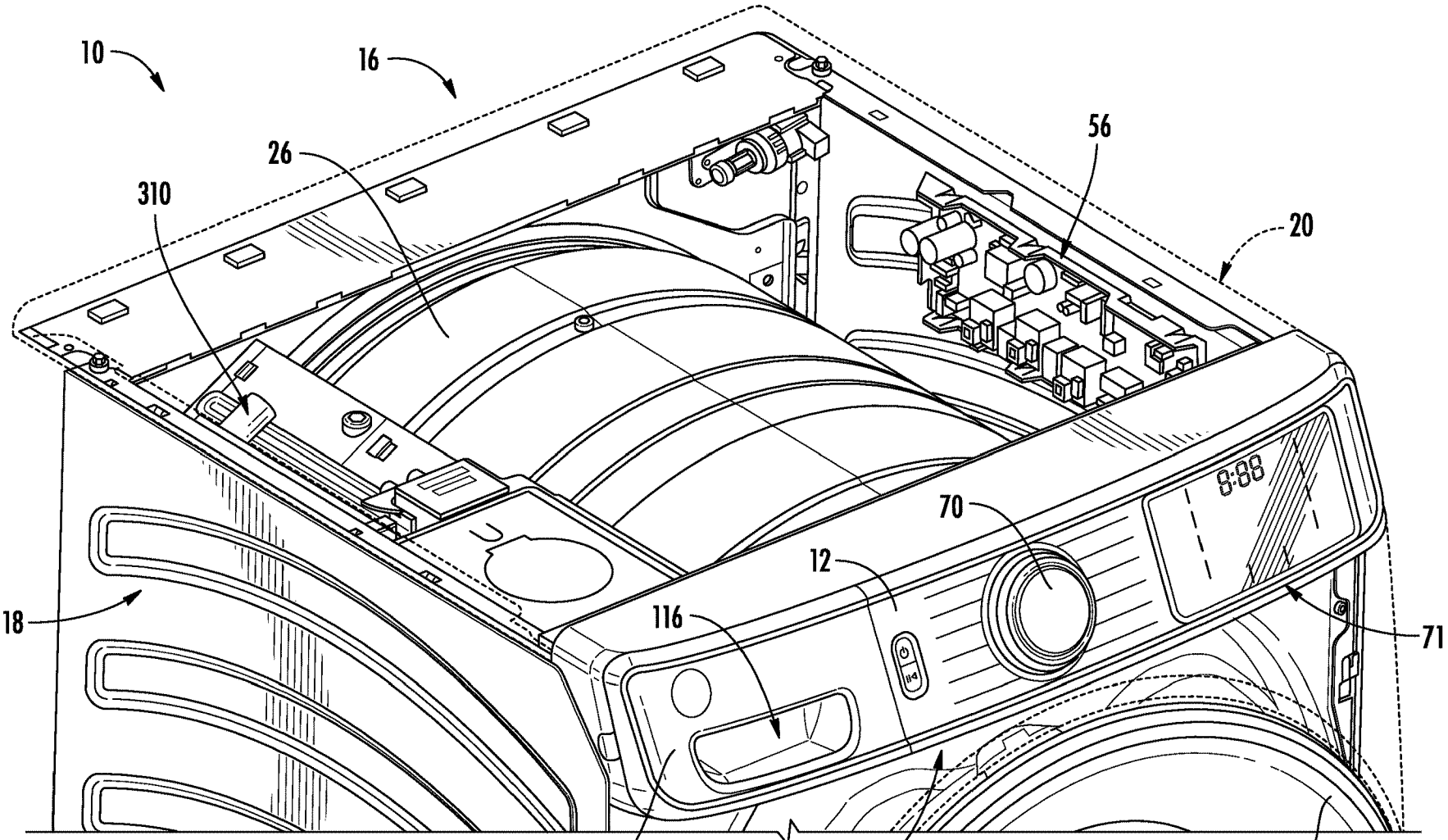
FIG. 3 provides a perspective view of a portion of the example dryer appliance of FIG. 1 with portions of the cabinet removed to reveal certain components of the dryer appliance.
Figure 4:
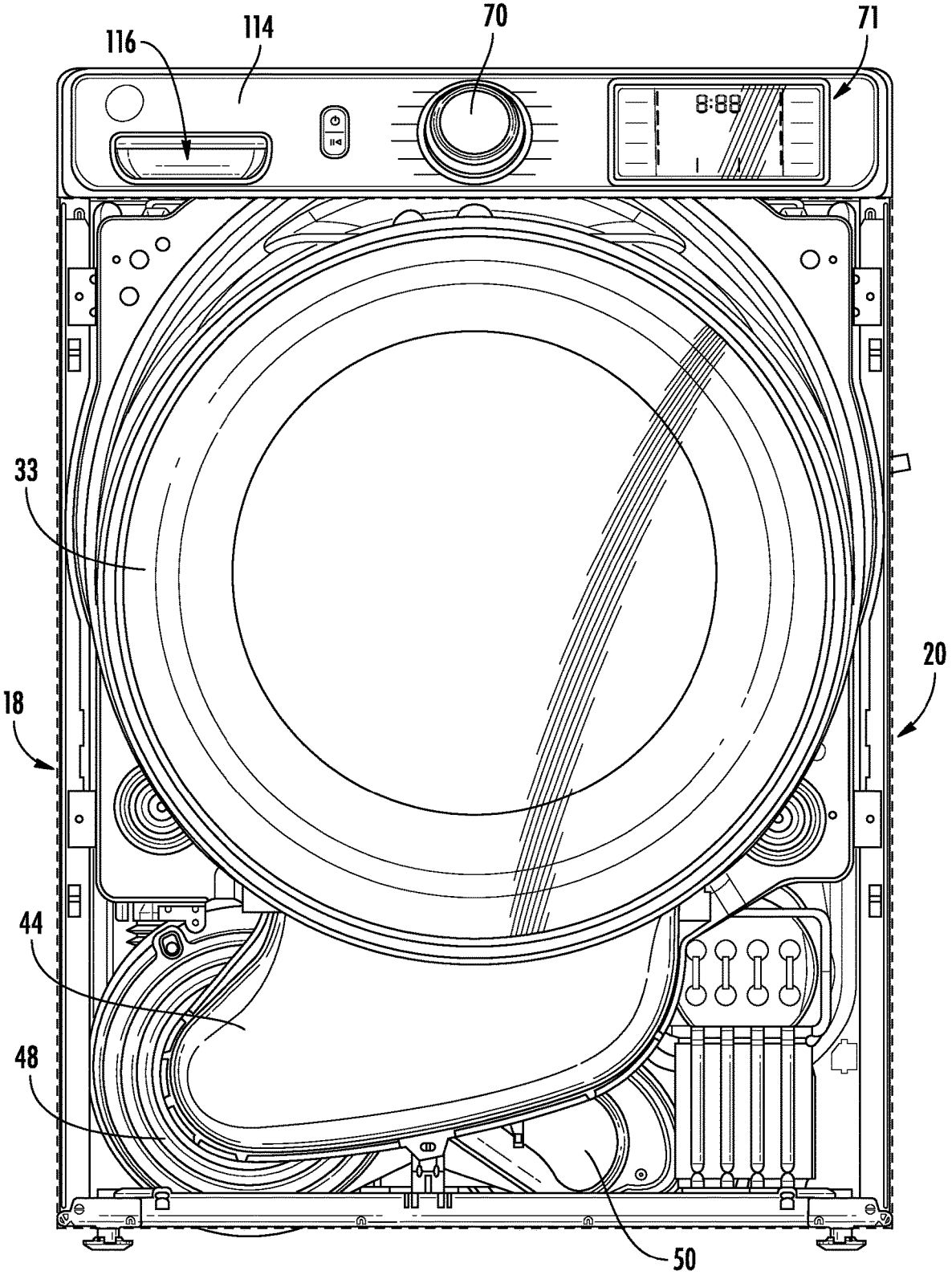
FIG. 4 provides a front view of the example dryer appliance of FIG. 1 with a portion of the cabinet removed to show reveal certain components of the dryer appliance.
Figure 5:
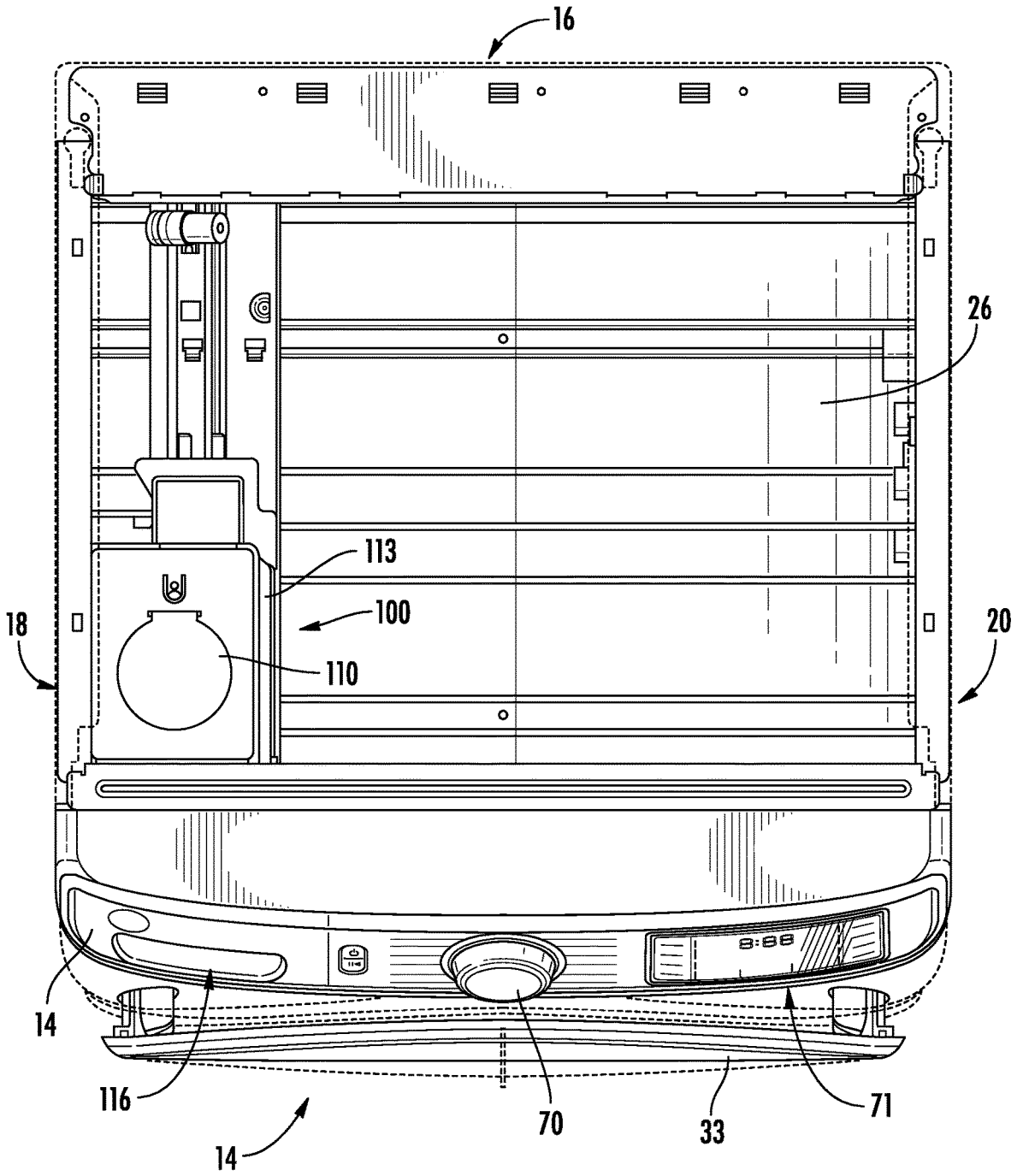
FIG. 5 provides a top-down view of the example dryer appliance of FIG. 1 with a portion of the cabinet removed to show reveal certain components of the dryer appliance.

Referring now to the figures, an exemplary laundry appliance that may be used to implement aspects of the present subject matter will be described. Specifically, FIGS. 1 and 2 provide perspective views of a dryer appliance 10 according to exemplary embodiments of the present disclosure. Particularly, FIG. 1 provides a perspective view of dryer appliance 10. FIG. 2 provides another perspective view of dryer appliance 10 with a portion of a housing or cabinet 12 of dryer appliance 10 removed in order to show certain components of dryer appliance 10. FIG. 3 provides a perspective view of a portion of dryer appliance 10 with a portion of cabinet 12 of dryer appliance 10 removed to show certain internal components of dryer appliance 10. FIG. 4 provides a front view of an embodiment of dryer appliance 10. FIG. 5 provides a top-down view of an embodiment of dryer appliance 10 with a portion of cabinet 12 removed to show certain internal components of dryer appliance 10.

As depicted in FIG. 1, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance, a condenser dryer, or any other suitable laundry appliance.

Cabinet 12 includes a plurality of panels including a front panel 14, a rear panel 16, a pair of side panels 18 and 20 (e.g., a first side panel 18 and a second side panel 20) spaced apart from each other by front panel 14 and rear panel 16 along the lateral direction L, a bottom panel 22, and a top cover 24. Cabinet 12 defines an interior volume 29. A container or drum 26 is mounted for rotation about a substantially horizontal axis within the interior volume 29 of cabinet 12. Drum 26 defines a chamber 25 for receipt of articles for tumbling and/or drying. As used herein, the terms "clothing" or "articles" includes but need not be limited to fabrics, textiles, garments, linens, papers, or other items from which the extraction of moisture is desirable. Drum 26 extends between a front portion 37 and a back portion 38, e.g., along the transverse direction T. Drum 26 also includes a back or rear wall 34, e.g., at back portion 38 of drum 26. For example, dryer appliance 10 may be configured as an electric dryer appliance with electrical heating elements or as a gas dryer appliance with gas heating elements (e.g., gas burners) for heating air. heater assembly 40

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes 39 that receive hot air that has been heated by a heater assembly 40. The heater assembly 40 may include a heat pump or refrigerant-based heater assembly. Moisture laden, heated air is drawn from drum 26 by an air handler 42 that draws air through chamber 25 of drum 26 when motor 31 rotates a fan assembly 48. In particular, ambient air, shown schematically via arrow 51, enters heater assembly 40 due to air handler 42 urging relatively cool ambient air 51 into the heater assembly 40. Such cool air 51 is selectively heated through the heater assembly 40 and is provided as heated air, shown schematically via arrow 52 to chamber 25. In various embodiments further described herein, heater assembly 40 may be non-activated or deactivated such that air 52, 53 provided to the chamber 25 is substantially similar to ambient air 51 (i.e., unheated). Air handler 42 draws heated air 52 through a duct 41, such as a back duct or first duct, to drum 26. Heated air 52 enters through the plurality of holes 39 and flows through chamber 25, such as depicted schematically via arrow 53. Within chamber 25, heated air 53 can accumulate moisture (e.g., from damp articles disposed within chamber 25). In turn, air handler 42 draws the moisture laden heated air, depicted schematically via arrow 54. Moisture laden heated air 54 enters through a duct 44. Duct 44 may form a front duct or second duct including a lint filter 46 (e.g., a screen filter) configured to collect lint during drying. The moisture laden heated air 54 passes through duct 44 enclosing filter 46, which traps lint particles. More specifically, filter 46 may include a screen, mesh, other material to capture lint in the air flow. The location of lint filters in appliance 10 as shown in FIG. 2 is provided by way of example only, and other locations may be used as well. As shown, lint filter 46 is readily accessible by a user of the appliance. Air then passes through air handler 42 to an exhaust duct 50, such as depicted schematically via arrows 55.

A door 33 provides for closing or accessing drum 26 through opening 32. According to exemplary embodiments, a window (not shown) in door 33 permits viewing of chamber 25 when door 33 is in the closed position, e.g., during operation of dryer appliance 10. Door 33 also includes a handle that, e.g., a user may pull when opening and closing door 33. Further, although door 33 is illustrated as mounted to front panel 14, it should be appreciated that door 33 may be mounted to another side of cabinet 12 or any other suitable support according to alternative embodiments. Dryer appliance 10 may further include a latch assembly 36 (see FIG. 1) that is mounted to cabinet 12 and/or door 33 for selectively locking door 33 in the closed position. Latch assembly 36 may be desirable, for example, to ensure only secured access to chamber 25 or to otherwise ensure and verify that door 33 is closed during certain operating cycles or events.

In some embodiments, one or more selector inputs 70, such as knobs, buttons, touchscreen interfaces, etc., may be provided or mounted on a cabinet 12 (e.g., on a user interface panel 71) and are communicatively coupled with (e.g., electrically coupled or coupled through a wireless network band) a processing device or controller 56. Controller 56 may also be communicatively coupled with various operational components of dryer appliance 10, such as motor 31, fan assembly 48, and/or components of heater assembly 40. In turn, signals generated in controller 56 direct operation of motor 31, fan assembly 48, or heater assembly 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

In various embodiments, the user interface panel 71 is positioned at the front panel 14. In particular embodiments, user interface panel 71 is positioned proximate to one of the pair of side panels and distal to another of the pair of side panels. In an embodiment, user interface panel 71 is positioned alongside second panel 20 and distal to first panel 18, e.g., distal along lateral direction L. Controller 56 is positioned proximate to one of the pair of side panels and distal to another of the pair of side panels. In such an embodiment, controller 56 is positioned alongside second panel 20 and distal to first panel 18, e.g., distal along lateral direction L.

Referring to FIGS. 3-5, embodiments of the dryer appliance 10 includes a reservoir 100 configured to receive and contain a fluid. The fluid may particularly include a cleaning solution, a disinfecting solution, a perfume or other scented solution, an antibacterial solution, an antimicrobial solution, an antimildew solution, a fungicidal solution, or combinations thereof. The reservoir 100 is in selective fluid communication with chamber 25 to provide fluid to the chamber 25. Dryer appliance 10 including the reservoir 100 allows the fluid to clean and disinfect the chamber 25, the drum 26, an outlet conduit 432 (FIG. 9) providing fluid connection between the reservoir 100 and the chamber 25, a fluid supply conduit 412 (FIG. 9) providing fluid connection from the reservoir 100 to a flow control device 400, and valves, connections, hoses, or other conduits and flow control devices therebetween.

In particular embodiments, the reservoir 100 includes a handle 116 forming a portion 114 of the front panel 14 of the cabinet 12. The reservoir 100 may be positioned at the front panel 14 proximate to another of the pair of side panels and distal to the controller 56. In an embodiment such as described above in regard to FIG. 3, reservoir 100 is positioned alongside first panel 18 and distal to second panel 20. Controller 56 is positioned alongside second panel 20 and distal to first panel 18 and reservoir 100. The portion 114 at which the handle 116 is formed may be positioned correspondingly proximate to first panel 18 and distal to the user interface panel 71 that is proximate to the second panel 20. However, it should be appreciated that other embodiments of dryer appliance 10 may position the reservoir 100 and handle 116 proximate to second panel 20. In such an embodiment, controller 56 and user interface panel 71 are positioned proximate to first panel 18. In various embodiments, selector inputs 70 may be positioned at the front panel 14 between (e.g., between along lateral direction L in FIG. 1) the user interface panel 71 and the reservoir 100.

Figure 6:
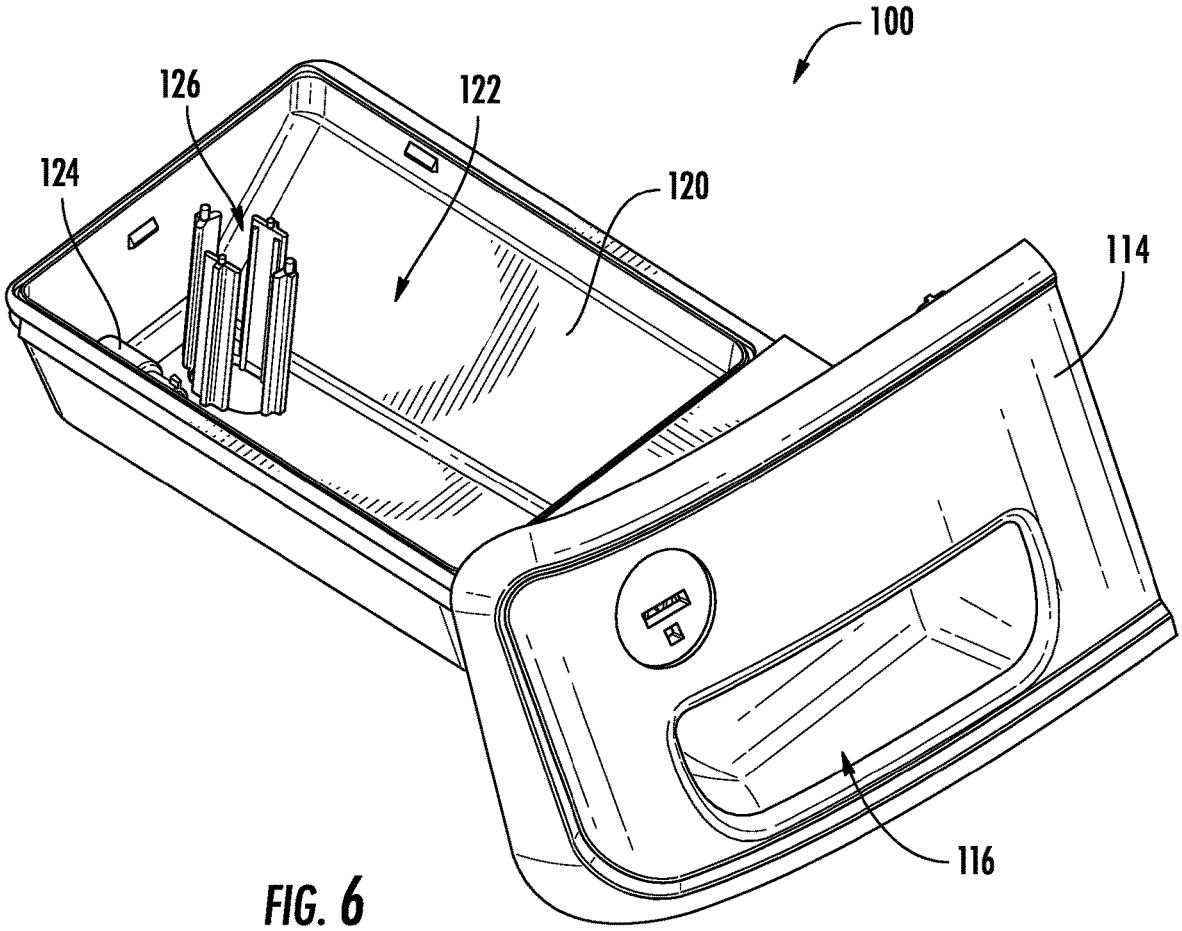
FIG. 6 provides a perspective view of a reservoir of the dryer appliance of FIG. 1 in accordance with exemplary embodiments of the present disclosure.
Figure 7:
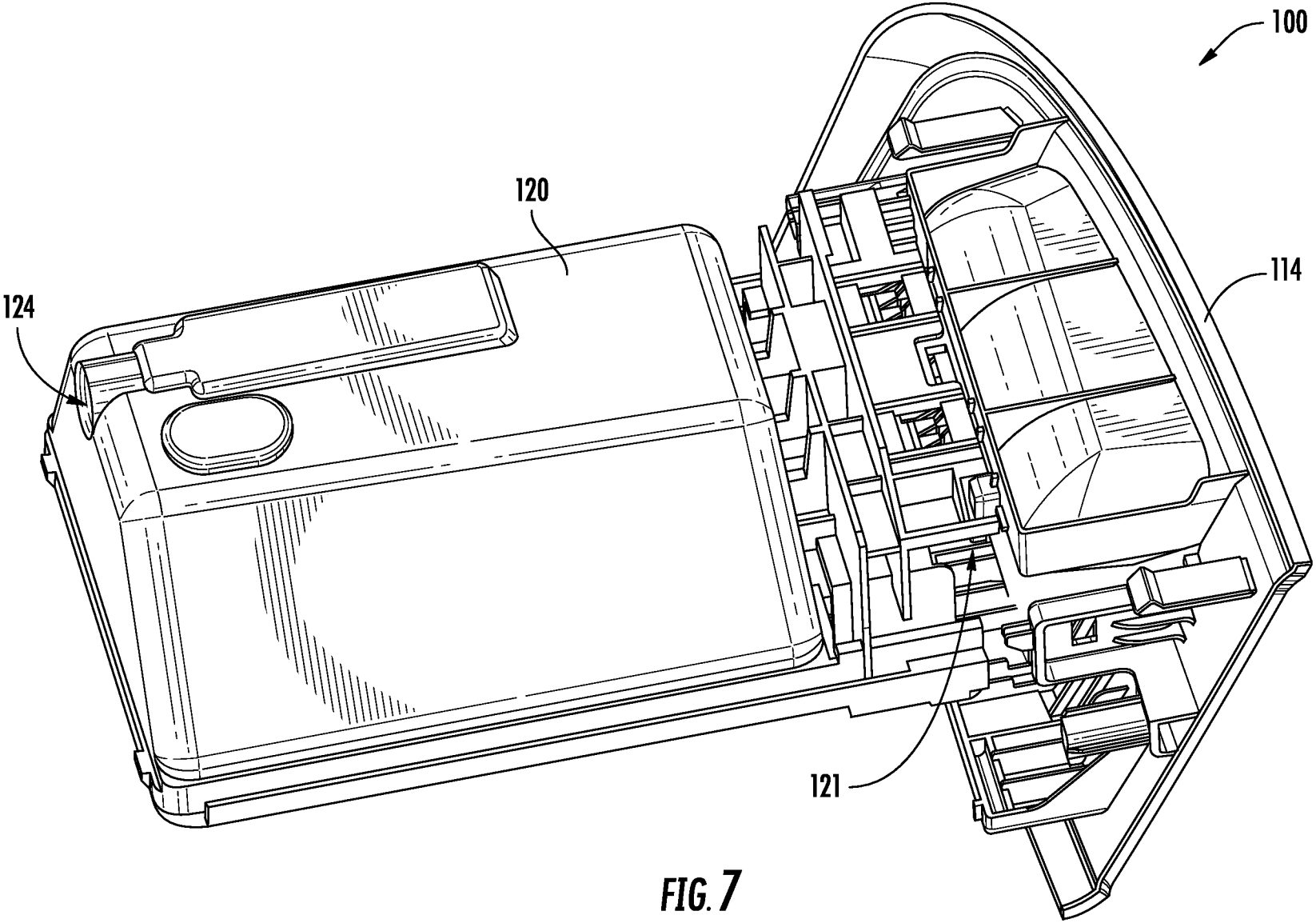
FIG. 7 provides a perspective view of the reservoir of the dryer appliance of FIG. 6 in accordance with exemplary embodiments of the present disclosure.

Referring now to FIGS. 6-7, perspective views of an exemplary embodiment of reservoir 100 are provided. Reservoir 100 includes a portion 114 of front panel 14. Portion 114 includes handle 116 configured to allow a user to pull, push, slide, or otherwise actuate the reservoir 100 into and out of the interior volume 29 (FIG. 2), such as along transverse direction T (FIG. 1). Accordingly, portion 114 may articulate to and from flush position with a remainder of front panel 14. A body 120 forms a compartment 122, such as a basin or trough, configured to hold or retain fluid. Body 120 may be separable or selectively detachable from portion 114 of front panel 14, such as at interface 121 forming a clip, snap, or other appropriate fit. In various embodiments, reservoir 100 includes a retainer 126 for a sensor, such as a fluid level sensor or other appropriate device for determining an amount of fluid at the compartment 122. Body 120 may form an outlet opening 124 through which fluid is allowed to egress from compartment 122.

Figure 8:
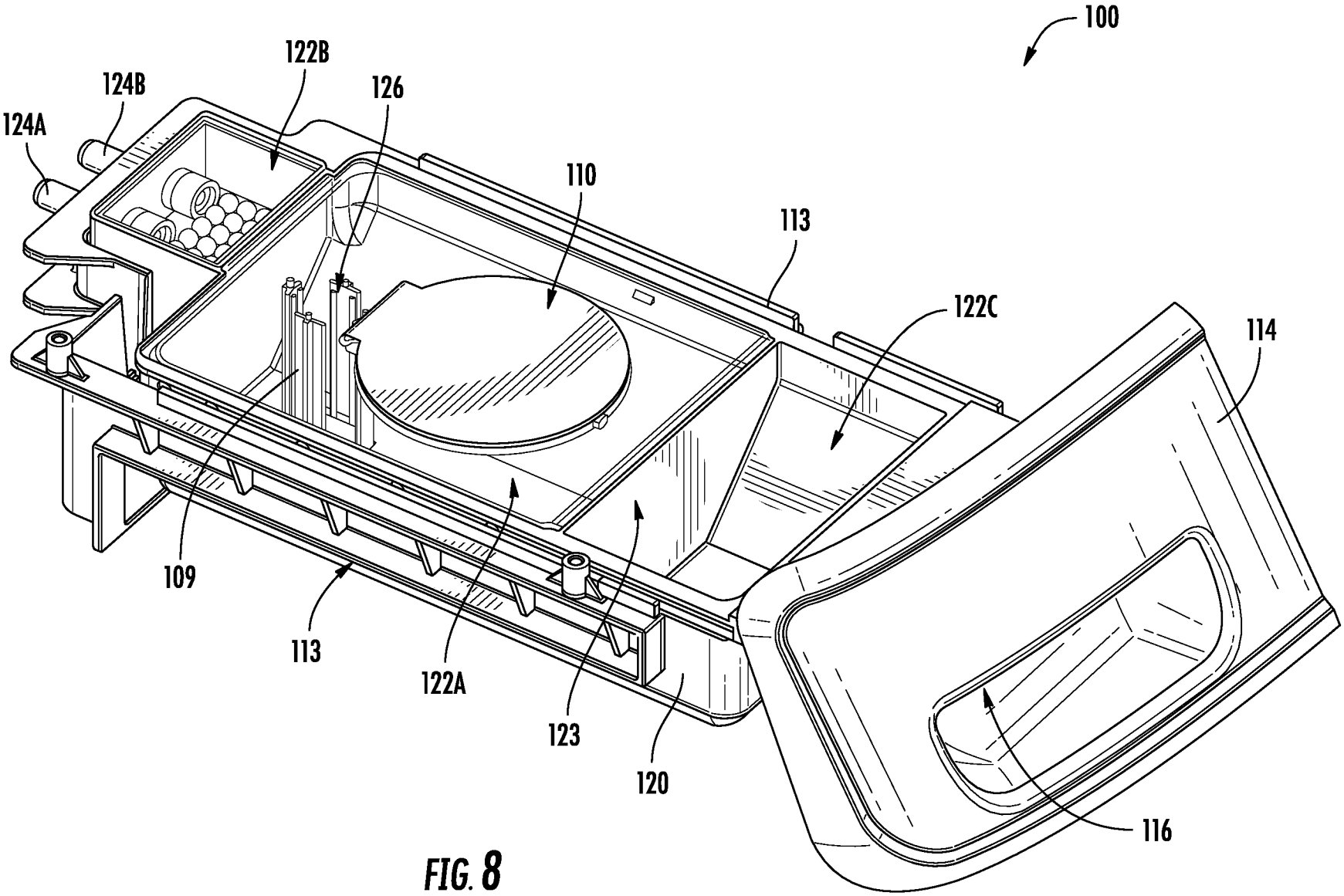
FIG. 8 provides a perspective view of a reservoir of the dryer appliance of FIG. 1 in accordance with exemplary embodiments of the present disclosure.

Referring now to FIG. 8, in certain embodiments, body 120 forms one or more of wall 123. Wall 123 may form a plurality of compartments 122, such as depicted as first compartment 122A, second compartment 122B, and third compartment 122C. One or more compartments may correspond to respective outlet openings 124A, 124B, such as to allow for separate fluids to selectively flow to the chamber 25. One or more compartments may include a cover 109 extending over the compartment, such as to limit vaporization, spillage, dissipation, or other loss of fluid from compartment. Cover 109 may include lid 110 configured to selectively open and close (e.g., hinged or detachable), such as to allow fluid to be added by user. Sliding mechanism or rail 113 extends alongside body 120, such as to allow reservoir 100 to slide into and out of interior volume 29 (FIG. 2) formed by cabinet 12.

Figure 9:
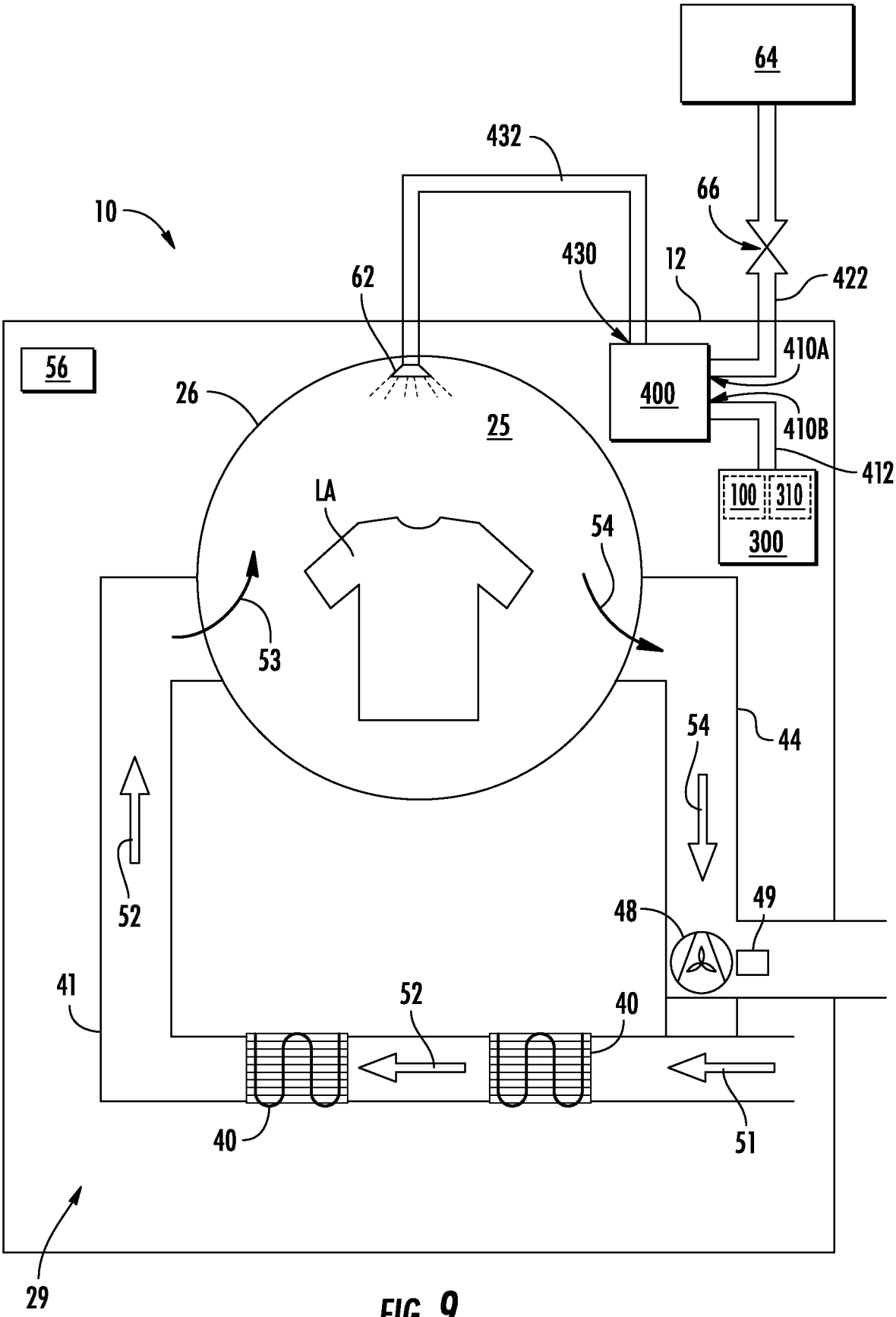
FIG. 9 provides a schematic diagram of an exemplary dryer appliance in accordance with exemplary embodiments of the present disclosure.

FIG. 9 provides an exemplary schematic view of a dryer appliance 10. Dryer appliance 10 may be configured to facilitate a cleaning, disinfecting, or perfuming process. As shown in FIG. 9, certain embodiments of the dryer appliance 10 include a misting nozzle 62 that is in fluid communication with a water supply 64 in order to direct mist into chamber 25. Dryer appliance 10 may further include a water supply valve or control valve 66 for selectively discharging the flow of mist into chamber 25. It should be appreciated that control valve 66 may be positioned at any other suitable location within cabinet 12.

The dryer appliance 10 may include one or more post-dry systems 300 including embodiments of reservoir 100 configured to provide a fluid (e.g., cleaning solution, disinfecting solution, perfume solution, etc.) to the chamber 25. In certain embodiments, the fluid solution is generally appropriate for application to laundry articles after a drying cycle. In various embodiments, the post dry system 300 includes a pump 310 (FIG. 3) configured to flow the fluid from reservoir 100 to the chamber 25. In certain embodiments, dryer appliance 10 includes a flow control device 400 configured to receive fluid from the post dry system 300. Fluid supply conduit 412 provides fluid communication of the fluid from the reservoir 100 to flow control device 400. The pump 310 is configured to selectively flow the fluid solution to the chamber 25. In particular embodiments, pump 310 is configured to selectively flow the fluid solution from the reservoir 320 through the fluid supply conduit 412 and through a flow control device 400. The pump 310 flows the fluid solution from reservoir 100 through one or more of a plurality of inlet openings 410A, 410B and through an outlet opening 430 of the flow control device 400.

The flow control device 400 includes a valve, such as a check valve, a non-return valve, a reflux valve, a retention valve, a foot valve, or, generally, a one-way valve, such as any appropriate valve configured to allow flow in a first direction (i.e., from the inlet opening 410 toward the outlet opening 430) and inhibit flow in an opposing second direction.

Referring still to FIG. 9, fluid supply conduit 412 is configured to provide the fluid from reservoir 100 to at least one of the plurality of inlet openings 410A, 410B. A second supply conduit 422 is configured to provide water or water vapor to at least one of another of the plurality of inlet openings 410A, 410B. An outlet conduit 432 is configured to provide the fluid and/or the water or water vapor through the outlet opening 430 to the chamber 25.

The flow control device 400 includes outlet opening 430 in fluid communication with the chamber 25 via outlet conduit 432. The flow control device 400 may include a first inlet opening 410A configured to receive water or water vapor through the first inlet opening 410A and a second inlet opening 410B configured to receive the fluid from the reservoir 100 through the second inlet opening 410B. The flow control device 400 may be configured to selectively provide fluid communication from the first inlet opening 410A and the second inlet opening 410B to the chamber 25 through the outlet conduit 430 connecting the chamber 25.

Embodiments of the dryer appliance 10 such as schematically depicted in FIG. 9 may furthermore facilitate a steam dry process. In this regard, dryer appliance 10 may offer a steam drying cycle, during which steam is injected into chamber 25, e.g., to function similar to a traditional garment steamer to help remove wrinkles, static, etc.

Figure 10:
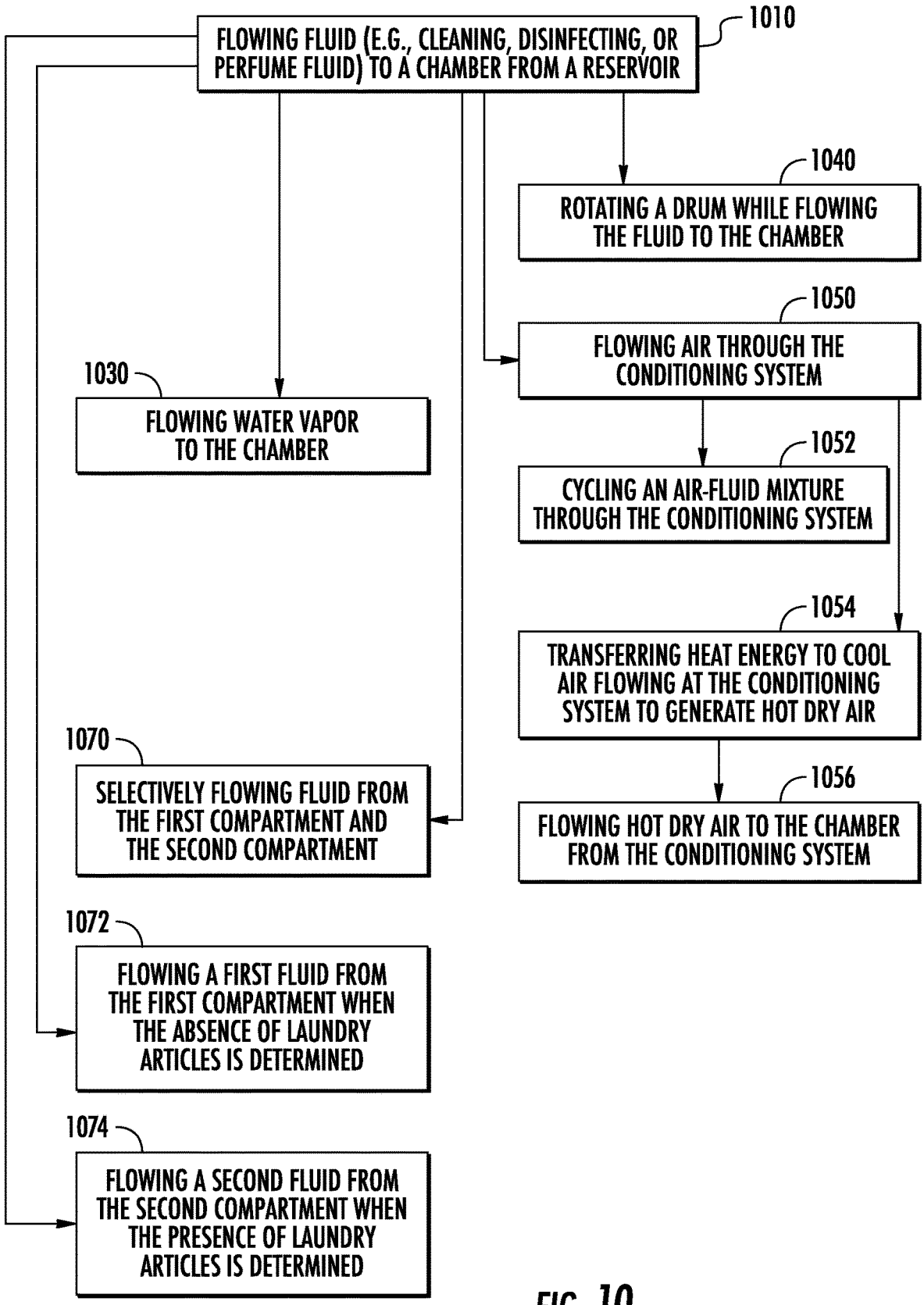
FIG. 10 provides a flowchart outlining steps of a method for operating a dryer appliance in accordance with aspects of the present disclosure.

Referring now to FIG. 10, a flowchart outlining steps of a method for operating a dryer appliance is provided (hereinafter, "method 1000"). Embodiments of method 1000 may be stored as instructions (e.g., via one or more memory devices) at controller 56 that, when executed by controller 56 (e.g., via one or more processors) causes the dryer appliance (e.g., dryer appliance 10) to perform operations. Accordingly, embodiments and steps of method 1000 may include computer-implemented methods for operating a dryer appliance. Steps of method 1000 may be performed in conjunction with one or more other steps not outlined herein, or may be rearranged, iterated, or combined with two or more other steps.

Method 1000 includes at 1010 flowing fluid to a chamber (e.g., chamber 25 for laundry articles) from a reservoir (e.g., reservoir 100 configured to retain a fluid or solid cleaning, disinfecting, or perfume material or solution). As provided herein, fluid is a cleaning solution, a disinfecting solution, a perfume solution, or other appropriate solution or material such as described herein. Accordingly, method 1000 includes a method for cleaning and disinfecting components of a dryer appliance, such as a chamber, conduits, or valves.

In certain embodiments, method 1000 includes at 1030 flowing water vapor to the chamber. In various embodiments, flowing water vapor includes flowing water vapor from a water supply (e.g., water supply 64). In a particular embodiment, flowing water vapor to the chamber is in serial operation with flowing fluid from the reservoir (e.g., reservoir 100) to the chamber (e.g., chamber 25). In a still particular embodiment, flowing water vapor to the chamber in serial operation with flowing the fluid from the reservoir to the chamber includes flowing water vapor and the fluid through the outlet conduit to the chamber (e.g., outlet conduit 432 fluidly connecting flow control device 400 to chamber 25).

Serial operation may particularly refer to providing one or the other of fluid or water vapor in a first instance in time to or through the outlet conduit and providing the other of water vapor or fluid in a second instance in time to or through the outlet conduit. Controller 56 may be configured to command (i.e., provide one or more control signals) iterative flow, or allowing flow therethrough, of water vapor and fluid from flow control device 400 through outlet conduit 432 to chamber 25. Serial operation, or serial flow, of water vapor and fluid through outlet conduit 432 to chamber 25 may include allowing amounts of fluid to mix at flow control device 400 or outlet conduit 432 with amounts of water or water vapor. Accordingly, certain embodiments of method 1000 include at 1032 mixing fluid and water or water vapor and flowing the fluid-water mixture to the chamber. Such embodiments may allow for concentrated fluid (e.g., concentrated perfume solution, disinfectant solution, cleaning solution, antimicrobial solution, antibacterial solution, fungicidal solution, or combinations thereof, etc.) to be desirably diluted with water before providing the fluid to the chamber.

Embodiments of method 1000 may include at 1040 rotating a drum (e.g., drum 26) while flowing the fluid to the chamber. Rotating the drum may allow for fluid, or diluted fluid, to land at various surfaces at drum or within the chamber. Additionally, or alternatively, rotating the drum may move the laundry articles when laundry articles are present in the chamber. The fluid may be provided while laundry articles are in the chamber, such as to allow the fluid to contact various surfaces of the laundry articles.

In various embodiments, method 1000 includes at 1050 flowing air through the heater assembly (e.g., heater assembly 40) to the chamber. In a particular embodiment, the method 1000 at 1050 includes operating a blower fan (e.g., fan assembly 48, or providing/receiving signals via sensor 49 at fan assembly 48) to flow air to and through the chamber 25. In one embodiment, flowing air to the chamber is in serial operation with flowing fluid to the chamber. In another embodiment, flowing air to the chamber is in parallel operation with flowing fluid to the chamber. Flowing air to the chamber may further include flowing air through the chamber and through a drum outlet (e.g., drum outlet 54). The method 1000 may include at 1052 cycling an air-fluid mixture through the heater assembly. The method 1000 at 1052 may allow for the fluid to contact surfaces and components at the heater assembly, such as to allow for cleaning and disinfecting of the duct 44, drum 26, exhaust duct 50, or other components.

In particular embodiments, flowing air through the heater assembly includes flowing cool air through the heater assembly and providing cool air to the chamber. Stated differently, flowing air through the heater assembly may particularly include non-heated air, such as to allow for dispersing the fluid through the chamber to various surfaces of the drum.

In other embodiments, method 1000 includes at 1054 transferring heat energy to cool air flowing at the heater assembly to generate heated air, such as described above in regard to FIG. 9. The method 1000 at 1056 includes flowing heated air to the chamber from the heater assembly. In certain embodiments, method 1000 at 1054 or 1056 may be performed prior to flowing and dispensing fluid to the chamber, such as at step 1010, such as to thermally prepare one or more surfaces to receive the fluid. In still certain embodiments, method 1000 at 1054 or 1056 may be performed after flowing and dispensing fluid at step 1010, such as to allow heated air to evaporate excess fluid at surfaces at which the fluid contacts.

Embodiments of the method may include flowing fluid to the chamber when the absence of laundry articles at the chamber is determined or when a user inputs a command (e.g., at user interface panel 71). In certain embodiments, particular fluids may correspond to whether the fluid may be applied to an empty chamber, a chamber with laundry articles, or both. For instance, referring back to FIG. 8, a first fluid may be contained at compartment 122A and a second fluid may be contained at compartment 122B. The first fluid may be appropriate for the empty chamber (i.e., absence of laundry articles in the chamber), and the second fluid may be appropriate for the presence or absence of laundry articles at the chamber. The method 1000 may include at 1070 selectively flowing fluid from the first compartment and the second compartment. In a particular embodiment, the method 1000 may include at 1072 flowing a first fluid from the first compartment when the absence of laundry articles is determined. The method 1000 may include at 1074 flowing a second fluid from the second compartment when the presence of laundry articles is determined. It should be appreciated that the method 1000 at 1074 may further include flowing the second fluid when the absence of laundry articles is determined.

It should further be appreciated that the reservoir 100 may be configured to receive one or more appropriate fluids such as described herein. Controller 56 may be configured to receive a user input indicative of the fluid provided to the reservoir, or to particular compartments of the reservoir. In other embodiments, controller 56 may correspond particular compartments 122 at the reservoir 100 to particular fluids. Method 1000, when executed by controller 56, may select the appropriate fluid based on a desired cleaning, disinfecting, or perfuming cycle.

Embodiments of dryer appliance 10, controller 56, and method 1000 provided herein allow for cleaning, disinfecting, and perfuming at a dryer appliance. Embodiments may include predetermining intervals or cycles at which the fluid is provided to the chamber or other components such as described herein. Additionally, or alternatively, embodiments of the method 1000 provided herein may include a user input or response that causes the method 1000 to execute. Embodiments provided herein may overcome issues associated with cleaning and disinfecting dryer appliances, or allow for desired perfumes and scents to be added to laundry articles, or both.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, the dryer appliance comprising:

a drum rotatably mounted within a cabinet, the drum defining a chamber for receipt of articles for drying;

a heater assembly in fluid communication with the chamber, the heater assembly comprising a fan assembly configured to flow air through the heater assembly, the heater assembly configured to selectively generate heat and remove moisture from the air flowing through the heater assembly;

an air handler configured to provide headed air through a duct from the heater assembly to the drum and from the drum to an exhaust duct;

a reservoir comprising a body having one or more walls forming a plurality of compartments, wherein the reservoir comprises an outlet opening respective to the plurality of compartments, the plurality of compartments each configured to receive a respective fluid, the fluid comprising a cleaning solution, a disinfecting solution, or a perfume solution at the plurality of compartments, wherein the reservoir is in selective fluid communication with the chamber to provide the fluid to the chamber, the reservoir comprising a handle forming a portion of a front panel of the cabinet, wherein at least one of the compartments for receiving the fluid is coupled to the handle, and wherein the reservoir is configured to slide into and out of an interior volume of the cabinet;

an outlet conduit connecting the chamber in fluid communication to receive the fluid from the outlet openings respective to the plurality of compartments of the reservoir, and the outlet conduit connecting the chamber in fluid communication to receive water vapor; and a controller communicatively couple to a user interface panel to receive user inputs, the controller configured to perform operations that, when executed by the controller, causes the dryer appliance to perform operations fro cleaning and disinfecting components of the dryer appliance, the operations comprising:

flowing the fluid to the chamber from the reservoir; and flowing, through the outlet conduit, water vapor to the chamber in serial operation with flowing fluid to the chamber;

rotating the drum while flowing the fluid to the chamber;

flowing air through the heater assembly and the drum via operation the fan; and cycling an air-fluid mixture through the heater assembly to provide fluid contact to clean or disinfect surfaces of the duct, the drum, and the exhaust duct.

2. The dryer appliance of claim 1, wherein flowing air to the chamber is in serial operation with flowing the fluid to the chamber.

3. The dryer appliance of claim 1, wherein flowing air to the chamber is in parallel operation with flowing the fluid to the chamber.

4. The dryer appliance of claim 1, wherein flowing air through the heater assembly comprises flowing cool air through the heater assembly and providing cool air to the chamber to disperse the fluid to surfaces of the drum.

5. The dryer appliance of claim 4, the operations comprising:

transferring heat energy to cool air flowing at the heater assembly to generate heated air; and flowing heated air to the chamber from the heater assembly to thermally prepare surfaces to receive the fluid or to evaporate excess fluid at which the fluid contacts.

6. The dryer appliance of claim 1, wherein the cabinet comprises:

a plurality of panels comprising a front panel, a rear panel, and a pair of side panels together forming an interior volume at which the drum is positioned, wherein the controller is positioned proximate to one of the pair of side panels and distal to another of the pair of side panels.

7. The dryer appliance of claim 6, wherein the reservoir is positioned at the front panel proximate to another of the pair of side panels and distal to the controller.

8. The dryer appliance of claim 7, wherein the user interface panel is positioned proximate to one of the pair of side panels and distal to another of the pair of side panels.

9. The dryer appliance of claim 1, the dryer appliance comprising:

a flow control device forming an outlet opening in fluid communication with the chamber, wherein the flow control device forms a first inlet opening configured to receive water or water vapor through the first inlet opening, and wherein the flow control device forms a second inlet opening configured to receive the fluid from the reservoir through the second inlet opening, the flow control device configured to selectively provide fluid communication from the first inlet opening and the second inlet opening to the chamber through the outlet opening and the outlet conduit attached thereto.

10. The dryer appliance of claim 1, the operations comprising:

selectively flowing the fluid from a first compartment and a second compartment of the plurality of compartments of the reservoir, wherein the operations comprise flowing a first fluid from the first compartment when an absence of laundry articles is determined from user input at the user interface panel, and wherein the operations comprise flowing a second fluid from the second compartment when a presence of laundry articles is determined from user input at the user interface panel.

11. A method for operating a dryer appliance for cleaning and disinfecting components of the dryer appliance, the method comprising:

flowing a fluid from a reservoir at the dryer appliance to a chamber configured to receive laundry articles for drying, the reservoir comprising a plurality of compartments, wherein the reservoir comprises an outlet opening respective to the plurality of compartments, the plurality of compartments each configured to receive a respective fluid, wherein the fluid is a cleaning solution, a disinfecting solution, or a perfume solution;

flowing water vapor to the chamber in serial operation with flowing fluid to the chamber;

rotating a drum at which the chamber is formed while flowing the fluid to the chamber;

operating a fan assembly to flow air through a heater assembly of the dryer appliance to the chamber; and cycling an air-fluid mixture through the heater assembly to provide fluid contact to clean or disinfect surfaces of the duct, the drum, and the exhaust duct.

12. The method of claim 11, the method comprising:

flowing cool air through the heater assembly and providing cool air to the chamber to disperse fluid to surfaces of the drum.

13. The method of claim 11, the method comprising:

transferring heat energy to cool air flowing at the heater assembly to generate heated air; and flowing heated air to the chamber from the heater assembly to thermally prepare surfaces to receive the fluid or to evaporate excess fluid at which the fluid contacts.

14. The method of claim 11, wherein flowing air through the heater assembly to the chamber is in parallel operation with flowing the fluid to the chamber.

15. The method of claim 11, wherein flowing air through the heater assembly to the chamber is in serial operation with flowing the fluid to the chamber.

16. The method of claim 11, the method comprising: selectively flowing fluid from a first compartment and a second compartment of the plurality of compartments of the reservoir, wherein the operations comprise flowing a first fluid from the first compartment when an absence of laundry articles is determined from user input at an user interface panel, and wherein the operations comprise flowing a second fluid from the second compartment when a presence of laundry articles is determined from user input at the user interface panel.

* * * * *